US006926082B2

(12) United States Patent
Wills et al.

(10) Patent No.: US 6,926,082 B2
(45) Date of Patent: Aug. 9, 2005

(54) WIRELINE FISHING SAFETY SLEEVE

(75) Inventors: Philip Wills, Aberdeenshire (GB); Jeremy Huthwaite, StoneHaven (GB)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/348,361

(22) Filed: Jan. 21, 2003

(65) Prior Publication Data

US 2004/0140101 A1 Jul. 22, 2004

(51) Int. Cl.[7] ..... E21B 19/00; E21B 31/00

(52) U.S. Cl. ..... 166/301; 166/75.11; 166/85.1; 166/242.2; 166/379; 166/385

(58) Field of Search ..... 166/301, 385, 166/85.5, 75.11, 85.1, 242.2, 65.1, 379

(56) References Cited

U.S. PATENT DOCUMENTS 2,187,007 A * 1/1940 Barnes ..... 166/241.5
4,635,718 A * 1/1987 Thomas ..... 166/254.2
4,832,128 A * 5/1989 Light et al. ..... 166/377
4,877,089 A * 10/1989 Burns ..... 166/377
5,392,851 A * 2/1995 Arend ..... 166/65.1
5,477,921 A 12/1995 Tollefsen
6,412,552 B1 7/2002 Rooks

* cited by examiner

*Primary Examiner*—Hoang Dang
(74) *Attorney, Agent, or Firm*—Darryl Springs; Timothy Donoughue; Keith Derrington

(57) ABSTRACT

A safety sleeve used with a wireline connection where the safety sleeve comprises an elongated body with an axial aperture formed along its axis. The wireline connection connects a severed wireline and can be comprised of a fishing spear and a fishing overshot. The safety sleeve axially encompasses the wireline connection assembly with its elongated body. The bending moment required to yield said safety sleeve is greater than the maximum bending moment experienced by the combination of the safety sleeve and the wireline connection during operation. The safety sleeve can also include a collar threadedly connectable to one side of the elongated body, a window formed along the elongated body, and a raised portion formed on the inner radius of the elongated body. The invention further includes a method of using the safety sleeve in conjunction with a wireline connection assembly.

12 Claims, 4 Drawing Sheets

WIRELINE FISHING SAFETY SLEEVE

BACKGROUND OF THE INVENTION

1. Field of the Invention

The invention relates generally to the field of oil and gas well operations devices. More specifically, the present invention relates to a method and apparatus to enhance safety when dislodging downhole tools from within a wellbore.

2. Description of Related Art

Certain procedures conducted in oil and gas producing wellbores are known as wireline operations. These operations typically involve attaching a wireline to a tool that lowers, supports, and raises the tool within the wellbore during wireline operations. In addition to the capability to raise and lower the tool within the wellbore, the wireline can also carry signals between the surface and the tool.

The path of a wellbore, while often containing long straight runs, can also include bends, elbows, or other discontinuities. On occasion, when the tool or wireline encounters these discontinuities, either the wireline or the tool can become wedged in the wellbore such that the force required to dislodged them exceeds the tensile strength of the wireline. To remove or dislodge the tool or wireline without breaking the wireline, the tool or wireline is often "fished" out of the wellbore. Fishing for downhole tools generally involves lowering a fishing tool into the wellbore on a string of pipe segments to the stuck tool or wireline. When the fishing tool encounters the stuck tool or wireline, it can be manipulated to grapple the stuck item and extract it from the wellbore.

To help guide the fishing tool to the stuck tool or wireline a cut and thread method is often used. Cut and thread operations involve severing the wireline above the surface (the top wireline 32) and attaching a wireline connection 28 to each severed end of the wireline. FIGS. 1*a* and 1*b* illustrate details of the fishing spear 10 and the fishing overshot 20 of the wireline connection 28. FIGS. 2*a*–2*c* depict certain aspects of a cut and thread operation. Typically a fishing spear 10 is attached to the portion of wireline that remains in the wellbore (bottom wireline 34) and a fishing overshot 20 is attached to top wireline 32. The fishing overshot 20, with attached wireline, is then threaded through a pipe segment 30 and mates with the fishing spear 10 on its upper end 26 to form a wireline connection 28. As the fishing spear 10 is inserted into the upper end 26 of the fishing overshot 20, the tip 14 of the fishing spear 10 contacts dogs 23 formed on the inside upward end of the latching fingers 22. The contact between the tip 14 and the dogs 23 pushes the upward end of the latching fingers 22 outward until the tip 14 travels past the dogs 23. The latching fingers 22 are spring loaded and will snap back into their original position after the tip 14 passes past the dogs. When the fishing spear 10 is fully inserted into the fishing overshot 20, the dogs 23 are proximate to the spear neck 15 and below the tip 14. The spring loaded latching fingers 22 maintain the dogs 23 in place behind the tip 14 and prevent the tip 14 from traveling past the dogs 23, this secures the fishing spear 10 to the fishing overshot 20.

After the wireline connection 28 is formed, the pipe segment 30 is then lowered into the wellbore, over the now connected fishing spear 10 and fishing overshot 20 until the wireline connection 28 emerges from the top of the pipe segment 30. When the wireline connection 28 is outside of the pipe segment 30, the fishing overshot 20 is disconnected from the fishing spear 10 by depressing the tab 21 on the latch fingers 22 and thus urging the dogs 23 out and away from the fishing neck 15. After the fishing overshot 20 is removed from the fishing spear 10 it can then be threaded through another pipe segment and the process repeated. The subsequent pipe segments 30 are attached to form a drill string that lengthens with each added pipe segment 30 until the fishing tool is in position to grapple and remove the stuck item.

Cut and thread fishing operations have always suffered a common hazard, as the drilling blocks/top drive 18 is lowered towards the drill floor 6, it deflects the top wireline 32 away from vertical. Deflecting the top wireline 32 from vertical causes the wireline connection 28 exiting the top of the pipe segment 30 to be suddenly exposed to a bending moment. In recent years the diameter of modern drilling top drives 18 has gradually increased, which in turn increases the deflection of the wireline 32 during fishing operations, which ultimately increases the bending moments exerted on the wireline connection 28.

As can be seen in FIG. 2*c*, this hardware arrangement, as well as many others, results in the top wireline 32 exiting the pipe segment 30 not exactly vertical, but instead at an angle from vertical. In situations when the top wireline 32 is not exactly vertical, the wireline connection 28 experiences a bending moment as it emerges from the pipe segment 30. This is a very dangerous situation if the applied bending moment exceeds the yield strength of the wireline connection 28. If the wireline connection 28 fractures during cut and thread operations, its respective pieces will most likely become airborne and are capable of causing serious bodily injury, including fatalities. Therefore, there exists a need for an apparatus and method to improve the safety of cut and thread wireline operations performed at a wellsite without hindering or slowing the cut and thread operations.

BRIEF SUMMARY OF THE INVENTION

The present invention involves a safety sleeve used with a wireline connection. The safety sleeve comprises an elongated body with an axial aperture formed along its axis. The wireline connection connects a severed wireline and can be comprised of a fishing spear and a fishing overshot. The safety sleeve axially encompasses the wireline connection within its elongated body. The bending moment required to yield the safety sleeve is greater than the maximum bending moment experienced by the combination of the safety sleeve and the wireline connection during operation. Further, when the safety sleeve is combined with the wireline combination, the safety sleeve will absorb all bending moments experienced by the combination during wireline operations, and the wireline combination will have no bending moment exerted on it. The safety sleeve can also include a collar threadedly connectable to one side of the elongated body, a window formed along the elongated body, and a raised portion formed on the inner radius of the elongated body.

Disclosed herein also is a method of performing a cut and thread wireline operation in a wellbore with a wireline connection having a safety sleeve comprising the steps of severing the wireline above the wellbore then passing a pipe segment over the severed section of wireline that is within the wellbore. Reconnecting the severed wireline sections with a connection assembly and forming a safety sleeve comprising an elongated body with an aperture axially passing therethrough. Positioning the safety sleeve around the connection assembly thereby forming a combination, where the bending moment required to yield the safety sleeve is greater than the maximum bending moment experienced by the combination during operation. The method can also include connecting a collar to one end of the safety sleeve and forming a window along the elongated body of the safety sleeve.

DETAILED DESCRIPTION OF THE INVENTION

Figure 3:
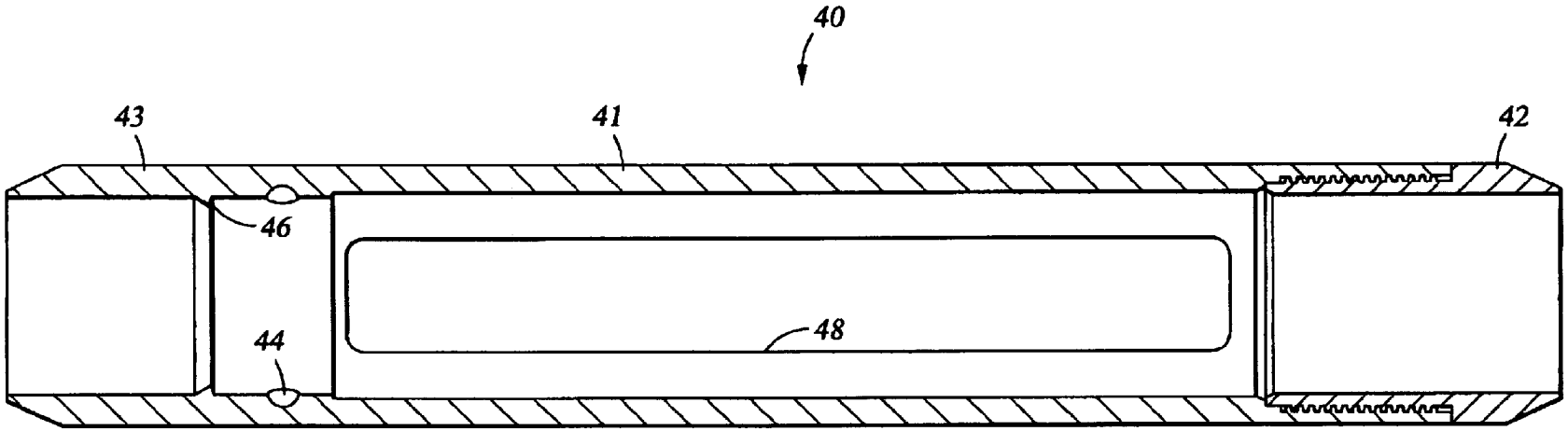
Figure 4:
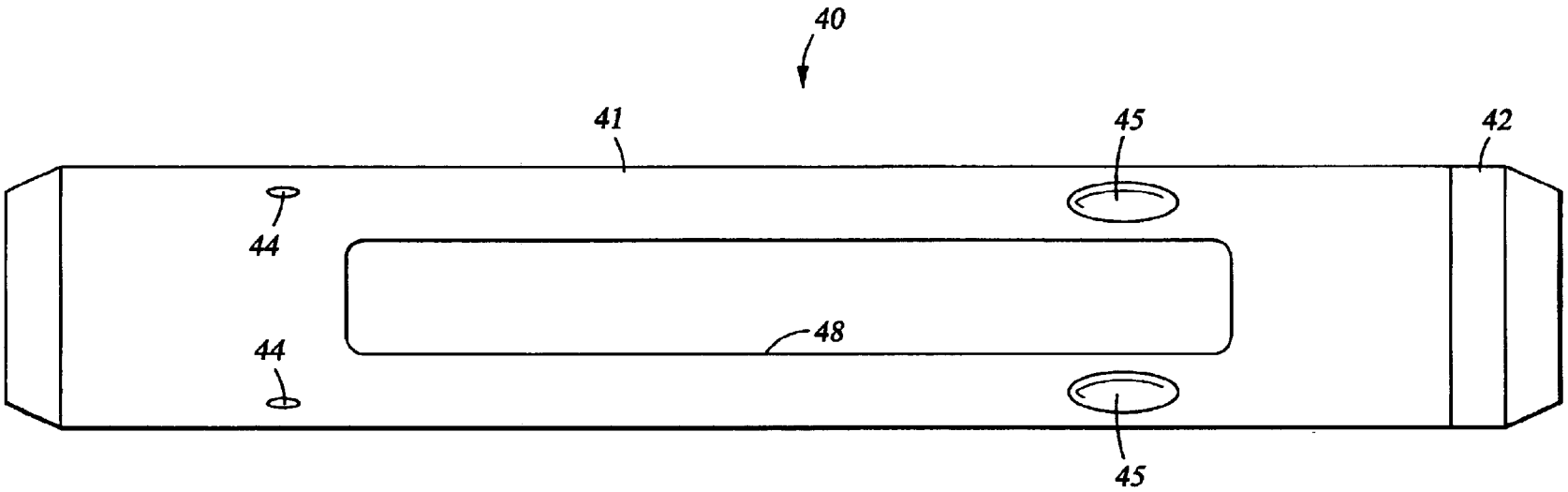
FIG. 4 illustrates a side view of one embodiment of the invention.

With reference to the drawings herein, a cross sectional view of one embodiment of the safety sleeve 40 of the present invention is depicted in FIG. 3. The safety sleeve 40 comprises a body 41 that is elongated and is substantially hollow. A collar 42 is formed for threaded connection onto one end of the body 40.

In operation, the safety sleeve 40 is positioned over a fishing overshot 20 such that the pin grooves 44 in the safety sleeve 40 are aligned with the pin grooves 24 of the fishing overshot 20. The pin grooves 44 are apertures formed perpendicular to the axis of the body 41. The pin grooves 24 on the fishing overshot are also perpendicular to the body of the fishing overshot 20. When pin grooves 44 are in alignment with pin grooves 24, pins (not shown) can be inserted through both the pin grooves 44 on the body and the pin grooves on the fishing overshot 20 thereby securing the safety sleeve 40 to the fishing overshot 20.

The raised shoulder 46 as illustrated in FIG. 3 is an additional novel feature of the present invention. When the fishing overshot 20 is inserted into the safety sleeve 40, the upper end 26 of the fishing overshot 20 is urged into mating contact with the raised shoulder 46. The location of the raised shoulder 46 ensures that the fishing overshot 20 is properly located within the safety sleeve 40 such that the pin grooves 24 and 44 are properly aligned before the pins are inserted into both sets of pin grooves 24 and 44.

As noted above, the fishing overshot 20 is released from the fishing spear 10 by mechanically depressing the tabs 21 on the latch fingers 22. Thus it is preferred that the window 48 and pin grooves (24 and 44) be aligned so that the tabs 21 can be accessed when the fishing overshot 20 is secured within the safety sleeve. Otherwise, during normal cut and thread operations the safety sleeve 40 would need to be removed in order to release the fishing spear 10 from the latch fingers 22.

When the safety sleeve 40 is mounted onto a wireline connection 28 that is comprised of a typical fishing spear 10 and fishing overshot 20, the skirt 43 can extend past the upper end 26 of the fishing overshot 20 and encompass most of the fishing spear 10. The presence of the safety sleeve 40 around the fishing overshot 20 will not hinder operations personnel from attaching or detaching the fishing spear 10 to or from the fishing overshot 20. Although the skirt 43 extends past the upper end 26 of the fishing overshot 20, it does not obstruct insertion of the fishing spear 10 into the fishing overshot 20. Further, the window 48 formed on the body of the safety sleeve 40 makes the tabs 21 fully accessible for manipulating the latch fingers 22 to release the fishing spear 10 from the fishing overshot 20.

Figure 1A:
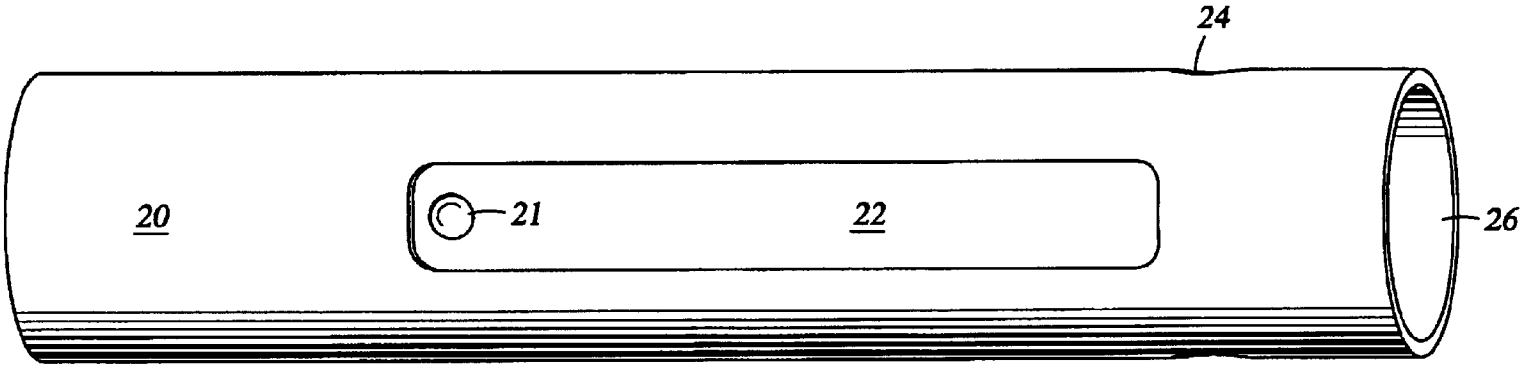
FIG. 1*a* is a perspective view of a prior art fishing overshot.
Figure 1B:
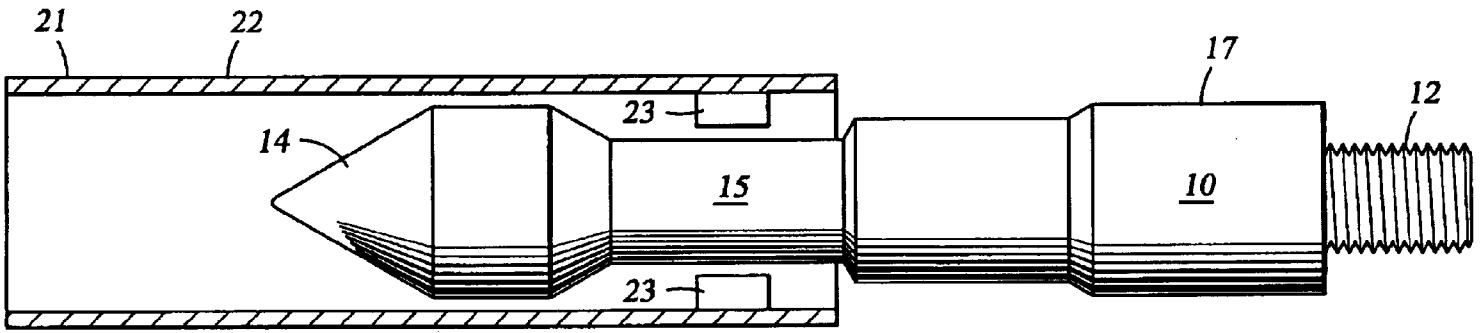
FIG. 1*b* depicts a cross section of a fishing spear in mechanical cooperation with the latching fingers of a fishing overshot.
Figure 2C:
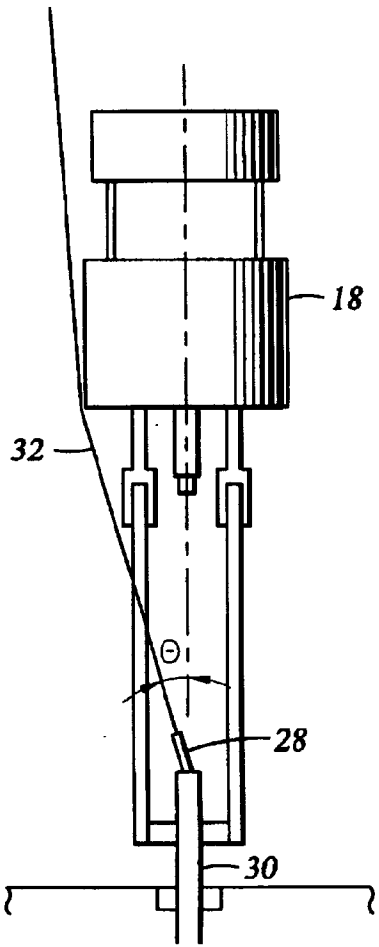
FIG. 2*c* depicts the wireline angle caused by a top drive.
Figure 2B:
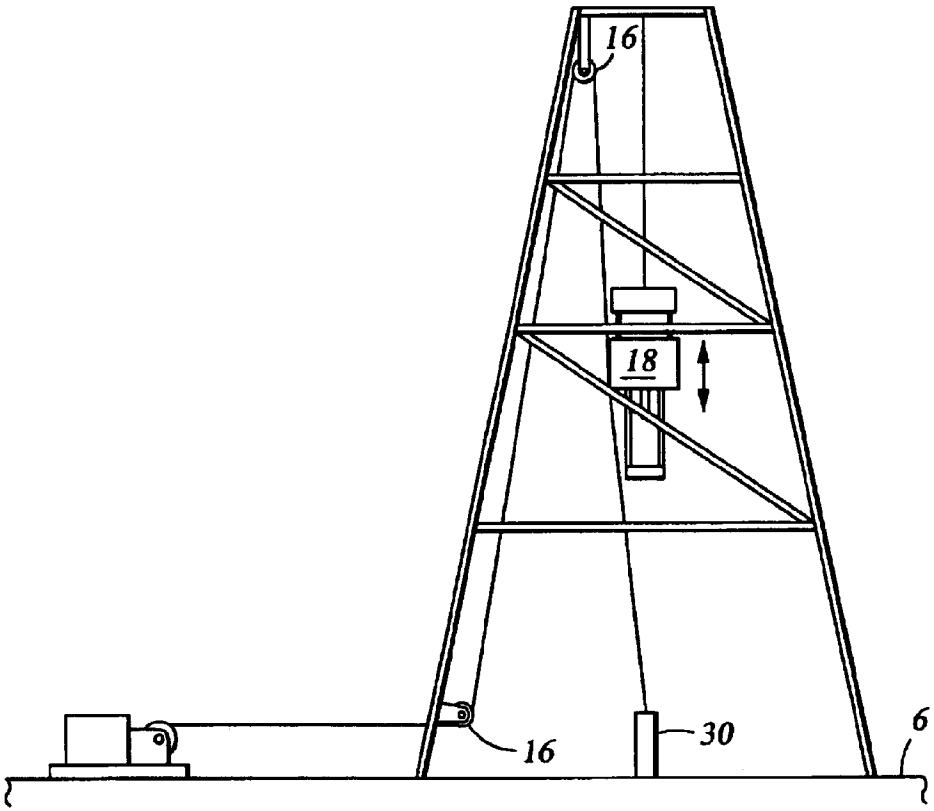
FIG. 2*b* depicts a possible wireline configuration during a cut and thread operation.
Figure 2A:
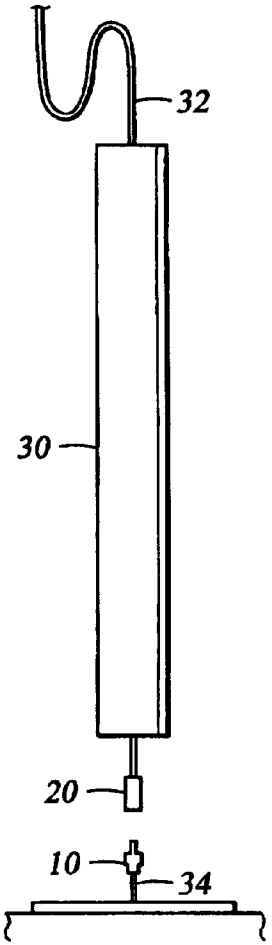
FIG. 2*a* illustrates a step in cut and thread operations.

During typical cut and thread operations the wireline connection 28 can be subjected to bending moments that exceed its yield strength. Inclusion of the safety sleeve 40 onto an existing wireline connection 28 prevents bending of the wireline connection 28 when the combination of safety sleeve 40 and wireline connection 28 is subjected to lateral forces. By preventing bending of the wireline connection 28 yield of the wireline connection 28 is also prevented. For example, lateral forces can be applied to the wireline connection 28 in situations as shown in FIG. 2*c*. There the top wireline 32 is at an angle $\theta$ with respect to the bottom wireline 34, which results in a horizontal bending moment on the wireline connection 28. Since during normal expected cut and thread operations the angle $\theta$ can exceed 90°, the safety sleeve itself should have sufficient strength to withstand bending forces produced when the angle $\theta$ reaches this value. It is believed that one skilled in the art can determine without undue experimentation the proper material and dimensions of the safety sleeve 40 to ensure it will not yield when subjected to these expected bending forces. Furthermore, when attached to a wireline connection 28, the safety sleeve 40 will absorb the entire bending moment subjected to the combination during all aspects of a wireline operation, including cut and thread operations. Accordingly, when combined with the safety sleeve 40, the wireline connection 28 will be shielded from any bending moment forces experienced during wireline operations.

To depress the tabs 21 in order to release the fishing spear 10 from the fishing overshot 20 a release tool (not shown) is often used to accomplish this. The release tool is similar to a pair of pliers so that the user of the release tool can depress both tabs 21 simultaneously with one hand to release the fishing tool 10 from the fishing overshot 20. To accommodate the use of the release tool when the safety sleeve 40 is secured to the fishing overshot 20, recesses 45 are provided on the outer surface of the safety sleeve 40 adjacent the window 48. The recesses 45 provide easy access for the unlocking portions of the release tool to contact the tabs 21.

With use the springs within the fishing overshot 20 will become worn and the latch fingers 22 tend to rest away from the outer diameter of the fishing overshot 20. This prevents the safety sleeve 40 from being produced at a tolerance close to the outer diameter of the fishing overshot 20. To eliminate the need for tight tolerances between the outside of the latching fingers 22 and the safety sleeve 40 an optional collar 42 is added to one end of the safety sleeve 40. The collar 42 enables the safety sleeve 40 to be assembled from both ends of the fishing overshot 20 so that it is unnecessary to assemble an item with tight tolerances over latching fingers 22 that may have become deformed with extensive use.

An alternative embodiment of the present invention comprises integrally forming a safety sleeve 40 with a fishing overshot 20 to create a unibody alternative. It is preferred that the unibody alternative have a wall thickness 27 greater than the wall thickness of a standard fishing overshot 20 and include a skirt that extends past the upper end 26 of a fishing overshot 20. The wall thickness 27 of the unibody version of the fishing overshot 20 should be of sufficient size such that its yield strength exceeds any expected bending moments the fishing overshot 20 is expected to experience during normal wireline operations. When the unibody alternative is mated with a fishing spear 10 it is preferred that its skirt extend up against the base 17 of the fishing spear 10.

Another embodiment of the unibody alternative includes the extended skirt, but the wall thickness of the unibody alternative would be substantially the same as the wall thickness of a typical fishing overshot 20. Due to variations in the inner diameter of particular pipe segments 30, it may not be possible to increase the outer diameter of a fishing overshot 20 past its typical diameter. Thus its wall thickness would have to remain the same.

One of the many advantages of the present invention is the ease in which safety sleeve 40 can be integrated with existing cut and thread wireline connections 28. Additionally, integration of the safety sleeve 40 with existing wireline connections 28 is entirely seamless; that is, once attached to a wireline connection 28 the safety sleeve 40 will not hinder linking to or detachment from the component parts of the wireline connection 28. Accordingly, neither the speed nor the efficiency of cut and thread wireline operations are affected by adding a safety sleeve 40 to a wireline connection 28.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of the manner and procedures for accomplishing the desired results. Such as, the shape, size or dimensions of the safety sleeve 40, as well as the manner in which it can be attached to an existing wireline connection 28. For example, the safety sleeve 40 can have an axial cross section that is some shape other than round, i.e. octagonal, rectangular, or triangular. These and other similar modifications will readily suggest themselves to those skilled in the art, and are intended to be encompassed within the spirit of the present invention disclosed herein and the scope of the appended claims.

What is claimed is:

1. A safety sleeve used with a wireline connection to form a combination, said safety sleeve comprising:

an elongated body having an axial aperture formed therethrough;

said safety sleeve axially encompassing the wireline connection with said elongated body such that the bending moment required to yield said safety sleeve is greater than the maximum bending moment experienced by said combination during wireline operation, wherein the wireline connection has two ends and is connected on one end to a portion of severed wireline and on its other end to another portion of severed wireline.

2. The safety sleeve of claim 1 further comprising a collar threadedly connectable to one side of said elongated body.

3. The safety sleeve of claim 1 further comprising a raised portion formed on the inner radius of said elongated body.

4. The safety sleeve in combination with a wireline connection of claim 1, where the wireline connection assembly is comprised of a fishing spear having two ends and an overshot having two ends, where one end of the fishing spear is connected to a portion of severed wireline and the other end of the fishing spear is formed for locking engagement with the overshot, and wherein one end of the overshot is connected to another portion of severed wireline and its other end is formed for locking engagement with the fishing spear.

5. The safety sleeve in combination with a wireline connection of claim 4 further comprising a skirt formed on one end of said elongated body and a base section formed on the fishing spear between each end of the fishing spear, wherein the skirt circumscribes the base when the fishing spear is in locking engagement with the fishing overshot.

6. The safety sleeve in combination with a wireline connection of claim 1 further comprising at least one window formed on said elongated body.

7. The safety sleeve in combination with a wireline connection of claim 1 further comprising at least one recess formed on the outer surface of said elongated body.

8. The safety sleeve in combination with a wireline connection of claim 1, wherein said safety sleeve absorbs the entire bending moment experienced by said combination during wireline operation such that the wireline connection is subjected to none of the bending moment experienced by said combination during wireline operation.

9. A method of performing a cut and thread wireline operation in a wellbore comprising the steps of:

severing the wireline above the wellbore;

passing a pipe segment over the severed section of wireline that is within the wellbore;

reconnecting the severed wireline sections with a connection assembly;

forming a safety sleeve comprising an elongated body with an aperture axially passing therethrough; and positioning the safety sleeve around the connection assembly thereby forming a combination, where the bending moment required to yield said safety shield is greater than the maximum bending moment experienced by said combination during the cut and thread wireline operation.

10. The method of claim 9 further comprising connecting a collar to one end of said safety sleeve.

11. The method claim 9 further comprising forming at least one through said elongated body.

12. The method of claim 9 further comprising forming at least one recess on the outer surface of said elongated body.

* * * * *